US007275490B1

(12) United States Patent
Sanders

(10) Patent No.: US 7,275,490 B1
(45) Date of Patent: Oct. 2, 2007

(54) SHALLOW DRAFT FLOATING VESSEL

(76) Inventor: Roy F. Sanders, 9512 Hopeland, Austin, TX (US) 78749

( * ) Notice: Subject to any disclaimer, the term of this patent is extended or adjusted under 35 U.S.C. 154(b) by 0 days.

(21) Appl. No.: 11/518,572

(22) Filed: Sep. 8, 2006

Related U.S. Application Data

(63) Continuation-in-part of application No. 11/139,939, filed on May 27, 2005, now Pat. No. 7,111,569.

(51) Int. Cl.
*B63B 1/00* (2006.01)

(52) U.S. Cl. ..... 114/61.2; 114/288; 441/65

(58) Field of Classification Search ..... 114/61.1, 114/61.2, 61.21, 288; 441/44, 45, 65, 74
See application file for complete search history.

(56) References Cited

U.S. PATENT DOCUMENTS

| | | | | |
|---|---|---|---|---|
| 4,192,249 | A * | 3/1980 | Vidal | 114/61.21 |
| 5,529,008 | A * | 6/1996 | Craig | 114/61.1 |
| 6,871,608 | B2 * | 3/2005 | Rosen | 114/61.1 |
| 7,111,569 | B1 * | 9/2006 | Sanders | 114/61.2 |

* cited by examiner

*Primary Examiner*—Lars A. Olson
(74) *Attorney, Agent, or Firm*—Buskop Law Group, PC; Wendy Buskop

(57) ABSTRACT

A catamaran-like one piece molded stable watercraft with sloping sides and a graduated sloping channel for supporting an individual and up to 600 pounds of gear without flipping and wherein the watercraft has a draft of no more than 6 inches fully loaded and less than 3 inches with 170 pounds of weight.

10 Claims, 7 Drawing Sheets

SHALLOW DRAFT FLOATING VESSEL

CROSS REFERENCE TO RELATED APPLICATIONS

The present application is a CIP to U.S. patent application Ser. No. 11/139,939 filed on May 27, 2005 now U.S. Pat. No. 7,111,569.

FIELD

The present embodiments relate generally to a lightweight floating vessel for fishing and repair of mid hulls, installation of endangered water plants and other uses. The lightweight floating vessel enables a person to stand on the vessel without flipping over during poling, rowing, fishing and other activities.

BACKGROUND

Fishing boats traditionally are standard monohull designs, such as those used for bass boats, Boston Whalers™ or standard rowboats. With a monohull designs, fishermen cannot stand up in the boat without flipping over the boat or simply falling out of the boat.

A need exists for a safer boat with a hull design in which a fisherman can stand up in during fishing, or poling without concern for tipping over that can be molded in a unitary construction that is fast to make, durable, and inexpensive to manufacture.

Metal bass boats, wooden boats and thick hulled fiberglass boats, like Boston Whalers' are heavy, and generally require at least two people to lift the boat onto a car top due to the weight. A need exists for an 11 foot to 18 foot vessel that can be lifted and used by one person without strain.

Boston Whalers and other heavy fishing boats can only be trailered because they are heavy. A need exists for a lightweight boat that can be car topped as well as stable for multiple uses, including use as a barge for transport in shall water.

Traditional fishing boats use a draft of between 6 inches and 20 inches, such as Boston Whalers. A need has existed for a fishing vessel, or similar vessel which can float over endangered plant life, such as sea grass in Florida, with a draft of only a few inches, such as 3 inches without harming the plant life, yet enabling a biologist for fish and wildlife ranger to stand up on the craft, safely without flipping over.

The present embodiments meet these needs.

BRIEF DESCRIPTION OF THE DRAWINGS

The detailed description will be better understood in conjunction with the accompanying drawings as follows.

Figure 1:
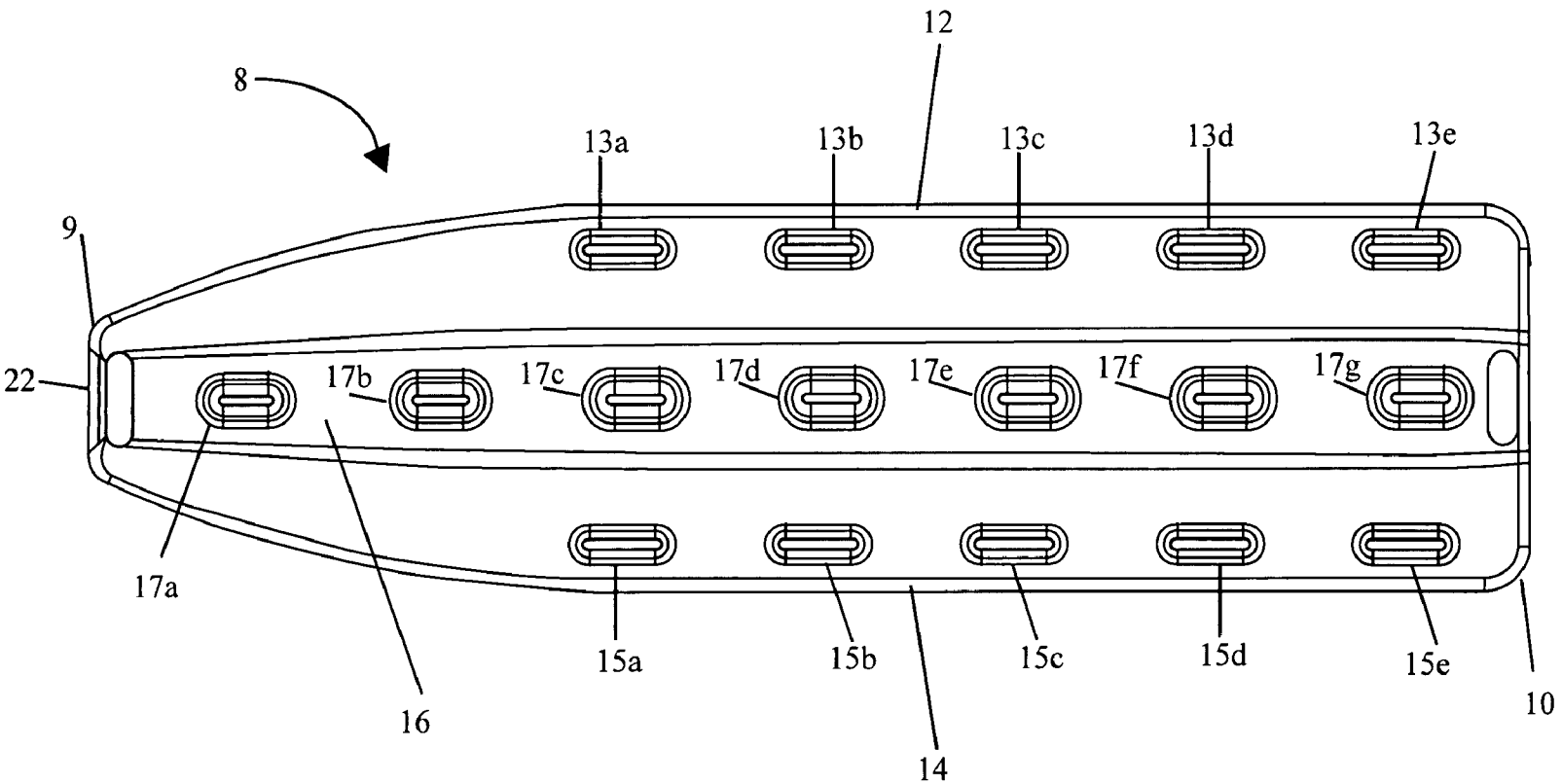
FIG. 1 depicts a bottom perspective view of an embodiment of the lightweight molded watercraft.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that the invention can be practiced or carried out in various ways.

The present embodiments relate to a watercraft that enables a person or two persons weighing up to a collective weight of 500 pounds to paddle or pole the vessel from a standing position for fishing, for biological study of plant life or planting of endangered species or for repair of floating structures. The watercraft has the feature of being highly stable while only requiring a draft in the water of only a few inches, less than six, and generally not more than 3 inches.

The watercraft is a one piece molded vessel preferably made of molded high density plastic. The vessel has a one piece hull, deck and sides, wherein the hull has a port hull section, and a starboard hull section connected by a mid hull section that forms a graduated water channel from bow to stern between the port and starboard hull section in the bottom of the vessel.

The graduated channel provides the vessel with increased stability in order to allow a person or persons to stand on the watercraft without tipping the vessel. The stability enables the vessel to be loaded to over 500 pound of gear without tipping over, while maintaining a draft of only a few inches.

Embodiments of the watercraft can be vessels between 10 feet to 20 feet in length. Watercrafts of the invention with lengths of 10.5 feet, 14 feet, 16 feet, and 18 feet are well adapted for commercial usage.

More specifically the vessel has a one piece molded compression hull with a port hull section having a port sloped edge, a port sloped bow, and a flat bottomed port stern. In addition a plurality of support columns extend from the bottom of the hull in the port section to the deck without penetrating the deck, forming holes in the bottom of the hull for trapping air and adding stability to the craft, and adding suction to the hull, enabling the hull to be more stable than a smooth bottomed vessel.

In addition, a starboard hull section has a starboard sloped edge, a starboard sloped bow, a flat bottomed starboard stern and a plurality of support columns extending to the deck forming holes in the bottom of the starboard hull section for trapping air.

As part of this one piece molded vessel, a mid hull section connects the port hull section to the starboard hull section keeping the two segments of the unitary hull in a spaced apart parallel relation and forming the graduated channel between the two hull section. In addition this mid hull section has a plurality of support columns extending to the deck forming holes in the bottom of the hull for the mid hull extension that serve to additionally trap air. These three segments from the bottom hull of the vessel.

The sloped edges of the hull section extend from bow to stern.

A deck is molded when the hull is molded forming a one piece craft. The deck connects to the sloped edges. The deck, and hull together form the watercraft with a water draft of less than 6 inches when loaded to 600 pounds and barely 3 inches when loaded to 170 pounds.

A stern handle is formed in the stern of the hull as a hole through the deck and through the hull. This integral stern handle enables the vessel to be lifted by the stern by a single individual. The handle is formed from the same material as the hull of the vessel and is formed at the time the entire vessel is molded. In this embodiment, there are no opening in the handle to permit air or other materials to enter the hull beneath the deck.

In an embodiment, the stern handle is designed to support 4 mounting screws or similar mounting pins that enable a trolling motor to be installed through the stern handle and secured to the vessel to provide a motorized vessel. The trolling motor can be a 2 hp trolling motor.

In a preferred embodiment, the material of the vessel is a moldable curable polymer, or polymer composite. The polymer can be homopolymer or a copolymer containing polypropylene, polyethylene, resins, or even some fiberglass.

The polymer material must be tough, strong, and lightweight. A tough hard plastic resistant to deformation in the presence of ultraviolet light, corrosive salt water, and impact adjustments such as when the user drops the vessel from a car top carrier or when the user drops something heavy, such as a 100 pound dog onto the vessel.

The material must be easy and quick to mold, low in cost, and able to have thin walls to keep the overall weight of the vessel between about 60 and about 90 pounds.

A bow handle is formed in the bow of the hull. The bow handle is integral to the hull and has a sealed construction. The bow handle is contemplated to be sturdy enough to support a rope or anchor line or dock line so that the vessel can be tethered safely for short periods if not in use without deforming the entire vessel.

At least one air release valve is contemplated to be disposed in the deck for emitting air when the watercraft becomes hot, preventing the bursting of the vessel due to air pressure. This air release valve would also be particularly useful when the vessel is taken from the altitude of Denver to the sea level altitude of Houston for releasing a building up of pressure. These pressure release valves also enable the vessel to be safely transported by cargo air carrier which may not have pressurized cargo bays.

Inside the vessel is inserted an expandable liquid foam to enhance buoyancy of the vessel and to increase strength of the vessel to prevent deformation or collapse of the vessel from selected weights being placed on the vessel.

A usable lightweight expandable foam filler is a urethane foam, such as polyurethane, polystyrene, styrene, or expandable polystyrene foam made by TAITA Chemical Co. LTD of Kaohsiung, Taiwan.

The deck of the vessel is formed with a dimpled or rough texture so that cargo does not slip off the vessel when the deck is wet. The texture is not sprayed on, it is formed in the mold so that no additional weight is added to the vessel. The dimpling is formed by spraying a release agent into the mold that creates a rough surface while not adding any material to the material of the vessel.

In an embodiment, shallow channels are formed in the deck as part of the molding process enabling water to run off the deck without adding any weight to the vessel.

Various sizes of the vessel are contemplated but generally the vessel is contemplated to have has an overall length from 8 to 18 feet, an overall width from 33 to 45 inches, a hull overall a depth from 6 to 8 inches resulting in a draft of between 1.5 and 6 inches when floating, generally less than 3 inches when loaded with 160 pounds of weight.

An embodiment of the invention contemplates a water craft, which can be individually propelled or a barge having a length of 11 feet a width of 35 inches and a hull depth of 6.5 inches An embodiment of the invention contemplates a water craft 12 feet in length, 36 inches in width and 6.5 inches deep.

Still another embodiment of the invention contemplates a water craft 14 feet in length, 38 inches inn width, and 7 inches deep.

In yet another embodiment of the invention, the deck of the vessel contains a plurality of grooves into which a seat can be slid for a stable, yet removable seat on the vessel usable by a fisherman or biologist.

The vessel can be individually propelled with an oar or pole such as with an elongated, adjustable oar or an elongated adjustable dual paddle oar. The oar or pole can be secured to the vessel deck when not in use with bungee cords through the handles.

With reference to the figures, FIG. 1 depicts a bottom view of an embodiment of a watercraft. The watercraft is a one-piece molded construction.

As shown in FIG. 1, the bottom side of an embodiment of the watercraft 8 made with a one piece molded compression hull having a vessel bow 9 and a vessel stern 10 an a graduated channel 11 extending from vessel bow to vessel stern wider in the vessel bow than in the vessel stern and shallower in the vessel bow than in the vessel stern.

The graduated channel 11 is between the port hull section 12 and the starboard hull section 14.

In this bottom view, the port and starboard hull section and the graduated channel each contain 4 support columns that extend from the bottom of the hull interior to the deck. The port hull section bottom 28 sports port support columns 13*a*, 13*b*, 13*c*, 13*d*, and 13*e* while starboard hull section bottom 30 sports starboard support columns 15*a*, 15*b*, 15*c*, 15*d* and 15*e*. The vessel can have at least 4 support columns and up to 10 support columns are in each hull section and between 3 and 10 support columns are in the mid hull section.

The bottom of the hull forming the channel is the mid hull section 16 and has mid hull section support columns 17*a*, 17*b*, 17*c*, 17*d*, 17*e* and 17*f*.

Integral to the bottom of the hull and penetrating to the deck, is a bow hole 20 forming the bow handle 22 and a stern hole 24 forming the stern handle 26.

Figure 2:
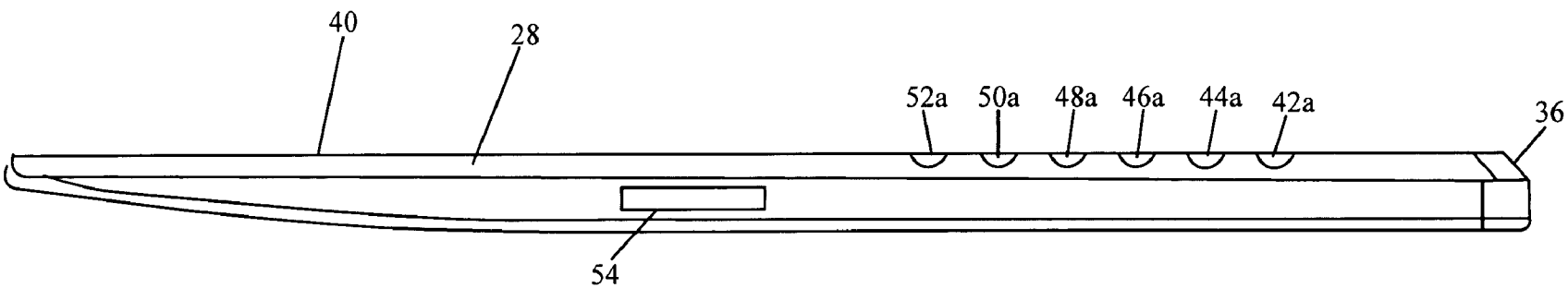
FIG. 2 depicts a port side view of an embodiment of the lightweight molded watercraft.

The port hull section and starboard hull section each have sloped edges, the port side hull is shown in FIG. 2. The sloped edges enable waves to roll down the craft, giving the craft a quieter effect on the water, having less wave noise, making the vessel less likely to scare endangered species like manatee, and to provide fishermen with the ability to not scare fish off. The sloped edges enable the vessel to have a stealth quality, it is designed to be extremely quiet with this design.

The watercraft requires very little draft. For example, the watercraft can use only three inches of draft, thereby making the watercraft usable in the shallowest of bodies of water of just a few inches while supporting a 165 pound man and a 100 pound Labrador retriever.

Figure 3:
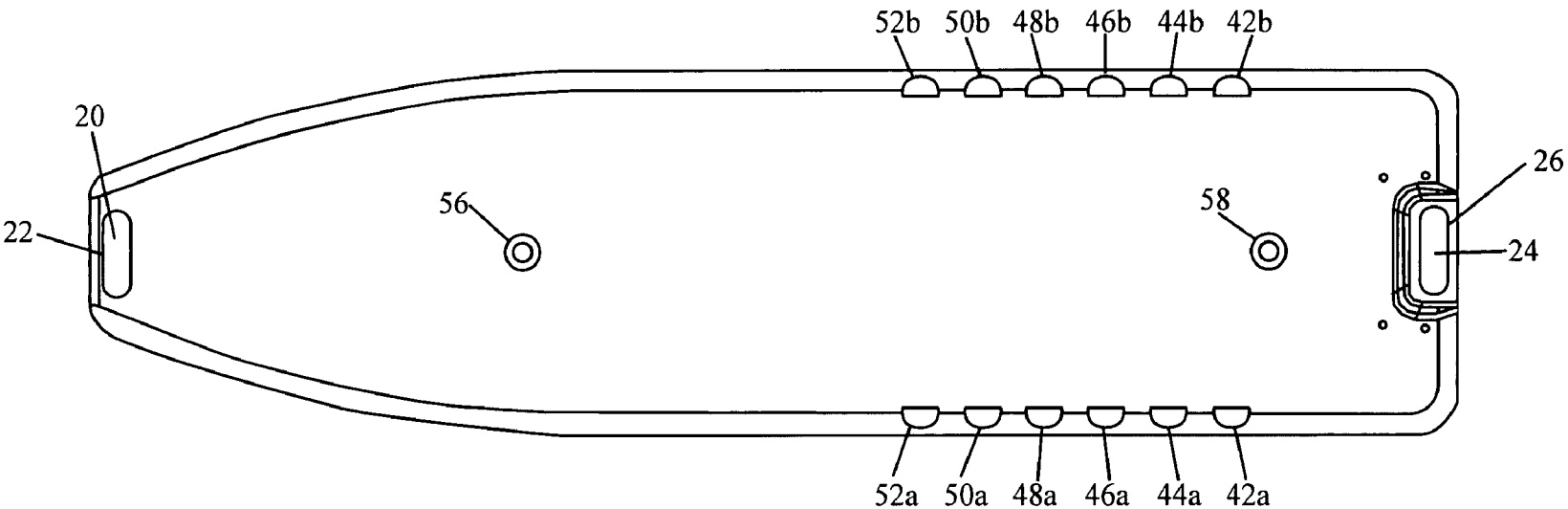
FIG. 3 depicts a top view of the lightweight molded watercraft.

FIG. 2 depicts is a port side view of an embodiment of the watercraft also termed vessel herein. FIG. 2 depicts the port sloped edges 28. The starboard sloped edges 30 are shown in FIG. 3, the top view. FIG. 2 also shows port bow 34 and a flat bottomed port stern 36. The sloped outside edges are integral with the deck 40. The watercraft allows a person to stand on top of the watercraft, and self propel the watercraft while the watercraft remains steady.

The one piece molded watercraft is so steady so that the person on the boat can cast a fishing line without worrying about tipping the boat or falling into the water FIG. 2 also shows grooves 42*a*, 44*a*, 46*a*, 48*a*, 50*a*, and 52*a* in the port side. In the starboard side, shown in FIG. 3, the opposing matching grooves 42*b*, 44*b*, 46*b*, 48*b*, 48*b*, 50*b* and 52*b* and are shown in order from stern to bow.

The grooves are molded just into the sloping edges for supporting accessories that are placed removably on the deck, such as a seat. However, the grooves are not required on a vessel when no accessory is desired. To support the seat in a secure way, yet permit the seat to be removable, a groove in the port side has a companion groove in the starboard side. Each groove receives a leg of the seat. An adjacent groove gain on the port side of the deck has a companion groove in the starboard side for receiving the remaining two legs of the removable seat.

In FIG. 2, the registration numbers 54 can be placed on each side of the hull. A logo can also be disposed on the hull near the registration numbers.

FIG. 3 shows a top view of the vessel 8. In this top view, the vessel bow 9 and the vessel stern 10. In this view it can be seen that the deck 40 extends over the integrated one piece molded hull. The deck, sides and hull are all a one piece molded craft.

Further the deck is formed to have at least one air release valve 56 disposed in the deck. A second air release valve 58 is also shown.

Figure 4:
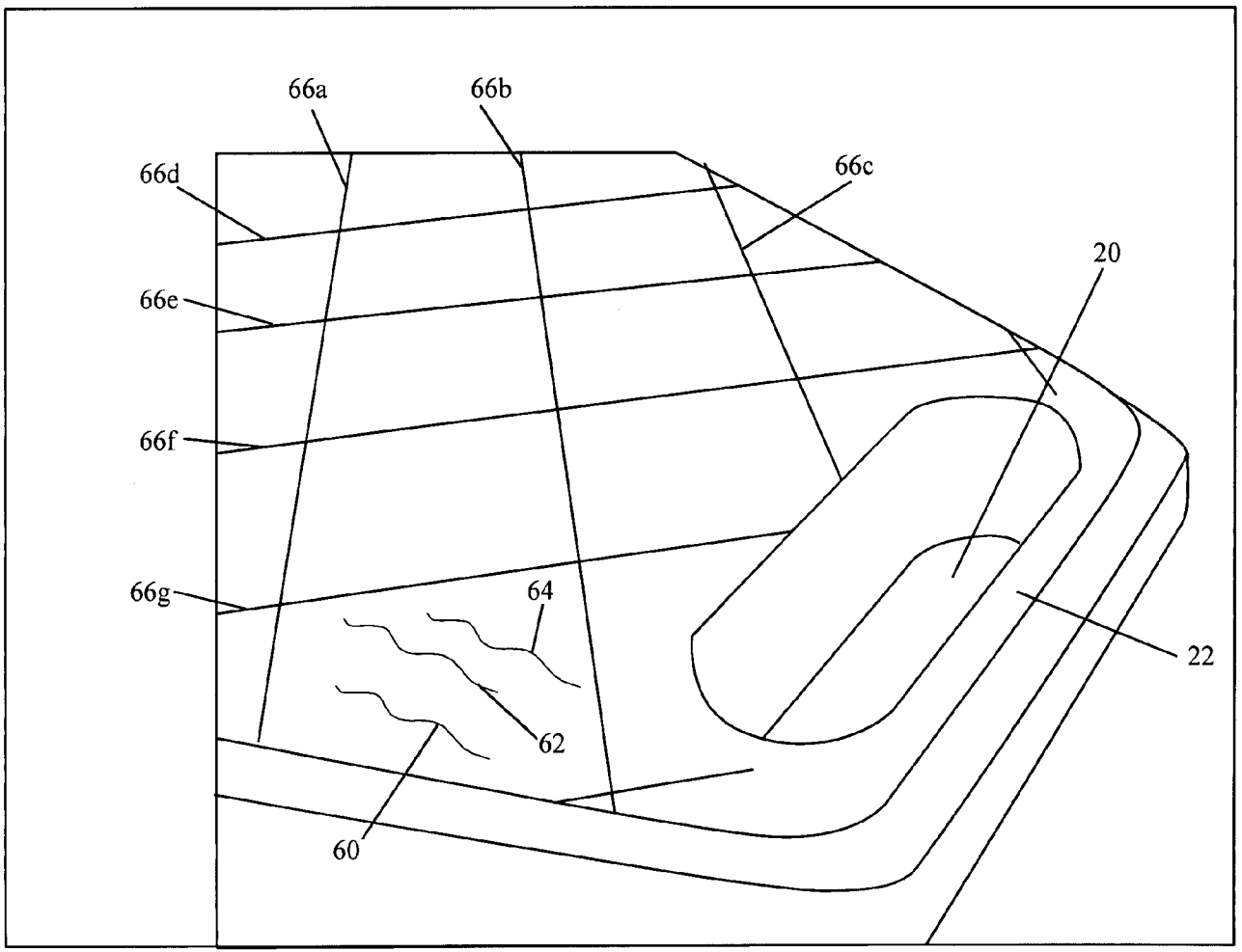
FIG. 4 depicts a perspective view of the bow of the watercraft.

FIG. 4 shows that the deck in an embodiment can be manufactured with skid reducing dimples 60, 62 and 64 creates a texture like a sidewalk which provide a non slip surface but does do not add any material to the craft.

The deck in an embodiment can also be made with shallow channels 66*a*, 66*b*, 66*c*, 66*d*, 66*e*, 66*f*, 66*g* enabling water to drain off the deck so that the water does not pool up on the deck. The channel also provides additional non-skid feature for a user.

Additional grooves can be created in the deck to provide the ability to move or reposition the seat as needed by the user.

Figure 5:
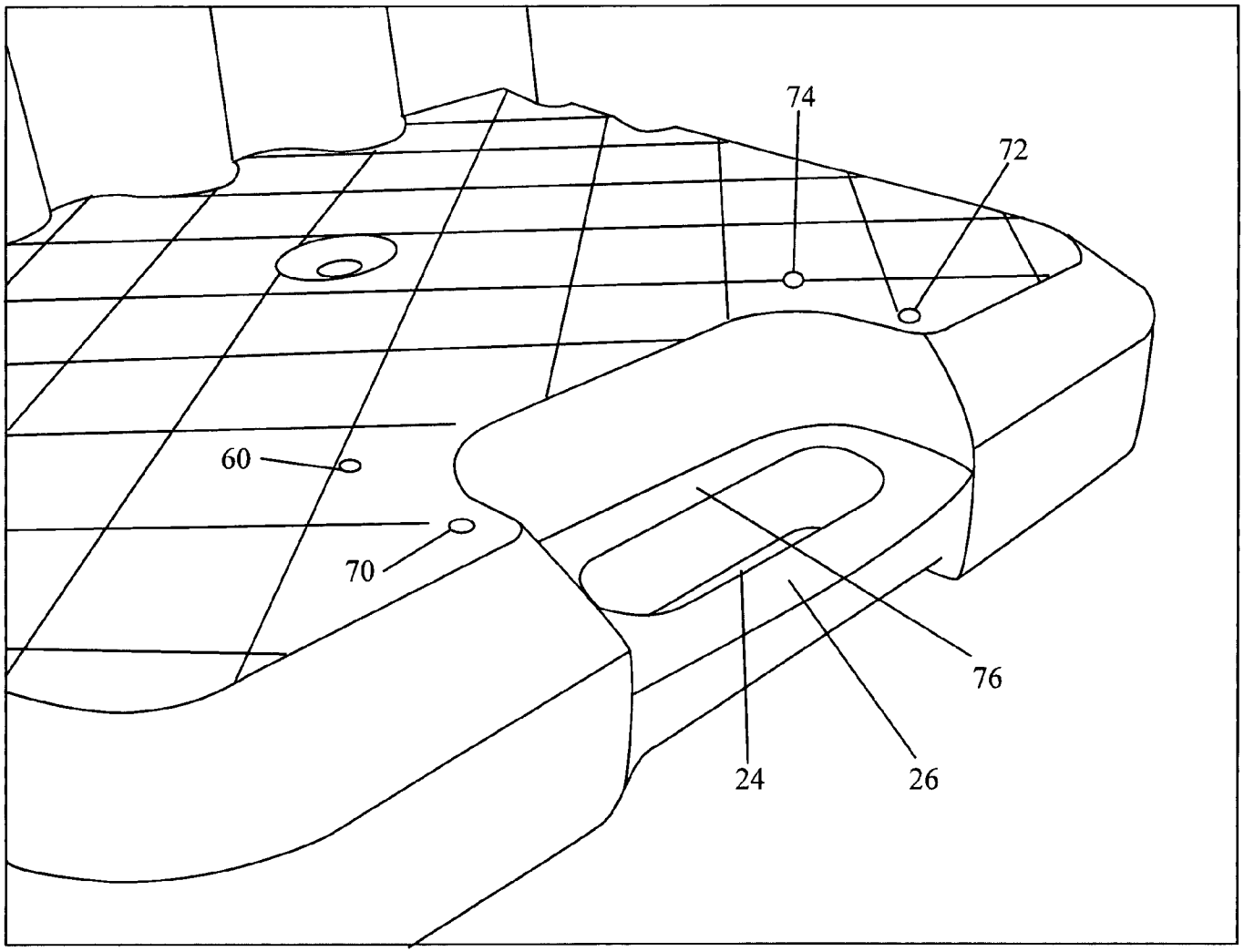
FIG. 5 depicts a perspective view of the stern of the watercraft.

FIG. 5 shows a detail of the vessel stern 10 of the craft. Stern hole 24 creates handle 26. In this detail four motor mount inserts 68, 70, 72, 74 are shown which are threaded into the deck to provide mounting position for a trolling motor (not shown).

In an embodiment, such as the one shown in FIG. 5, a support bridge 76 opposite the stern handle can be molded into the stern to provide support to the motor mount and prevent deformation due to the weight or action from an attached trolling motor.

Figure 6:
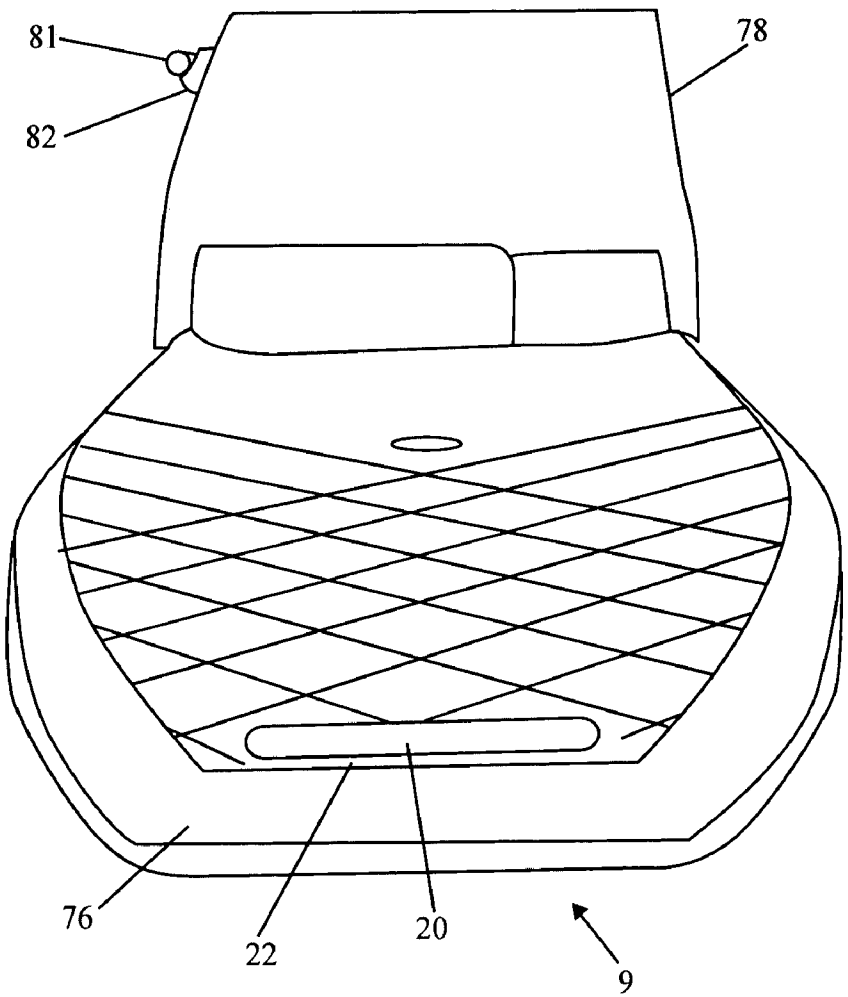
FIG. 6 is a front view of the vessel bow.

FIG. 6 shows a top view of the vessel bow 9. In an embodiment of the vessel the vessel bow 9 can have a bow sloped edge 76, however it is possible to have a vessel without a bow sloped edge and still be usable within the scope of the invention. The bow handle 22 is shown as well as bow hole 20 which enable a line, such as a dock line, anchor line, or tow line to be threadable through the hole and tied to the handle for towing the vessel or securing to a dock, or anchor.

A seat 78 is shown in FIG. 6 which can be an insulated container for holding items, such as food, drinks, or caught fish. The seat can be made of a plastic which is light, and hollow yet strong enough to support the weight of an individual while holding a stash of caught fish. The seat can sport an oar holder 80 for holding an oar 82 for use in propelling the vessel. The seat can be filled with a foam for buoyancy.

Figure 7:
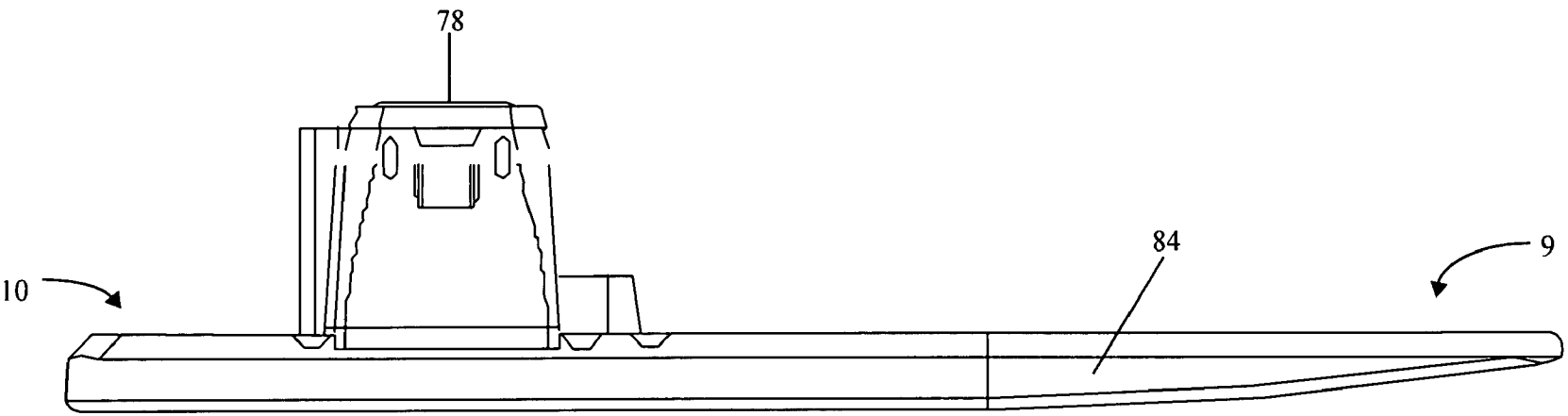
FIG. 7 is a cross sectional view of the vessel with a seat disposed on the deck.

FIG. 7 shows a cutaway view of the vessel, containing filler 84 which can be a foam, closed cell material. The vessel is firm crafted from a molded plastic then liquid expandable foam is inserted into the craft, such as through the air release valves and then allowed to expand forming a virtually unsinkable craft.

The embodied watercraft can have one or more floundering lights secured to the body and powered by an energy source, such as a fuel cell. A floundering gig can be secured to one or more of the floundering lights.

The graduated channel is about 2 inches deep at the stern and tapers to the bow for a 14 foot craft.

The graduated channel is about 1.5 inches deep at the stern and tapers to the bow for an 11 foot craft.

For longer watercrafts, the channel can be slightly deeper at the stern and taper to the bow. The channel graduated channel compresses water into a more confined space. By compressing the water, the compressed water in the hull acts as a rudder to provide directional stability. The compressed water travels at a different speed from the water on the outside of the hull enabling the hull to move in a straight line without needing a rudder. The directional stability allows the embodied watercraft to be poled or oared in a straight line, in contrast to other watercrafts of a catamaran style that veer off a course by at least 10 degrees. The directional stability is accomplished in the embodied watercraft by hull design.

The bow can provide a slope from deck into the water that is nearly a 20 degree angle and can extend for at least 3-foot in smaller watercrafts of about 11 feet. In various embodiment the sloping bow from deck to hull bottom can be between 20% and 35% of the overall length of the craft. For example, a 14 foot craft it can slope for 4 feet. For an 11 foot craft, the bow can slope 3 feet.

In an embodiment the deck slopes from the vessel bow to the widest portion of the vessel hull at an angle of about 25 degrees.

The slope of the sloped edge from the deck to the sides of the hull is about 45 degrees.

The embodiments have been described in detail with particular reference to certain preferred embodiments, thereof, but it will be understood that variations and modifications can be effected within the scope of the embodiments, especially to those skilled in the art.

What is claimed is:

1. An one piece molded vessel comprising:

a. A one piece molded compression hull having a vessel bow and vessel stern and a graduated channel shallower in the vessel bow than in the vessel stern comprising: a deck integral with a hull, wherein the hull comprises:

a port hull section comprising a port hull bottom integrally connected to a port sloped outside edge, forming a port sloped bow and a flat bottomed port stern and wherein the port hull bottom further comprises a plurality of port support columns extending from the port hull bottom to the deck and the columns form holes in the port hull bottom;

a starboard hull comprising a starboard hull bottom integrally connected to a starboard sloped outside edge forming a starboard sloped bow and a flat bottomed starboard stern, and wherein the starboard hull bottom further comprises a plurality of starboard support columns extending from the starboard hull bottom to the deck and the columns form holes in the starboard hull bottom;

a mid hull section between the port hull section and the starboard hull section maintaining the port and starboard hull sections in a spaced apart parallel relation and wherein the mid hull section has a mid hull section sloping bottom side forming a graduated channel, and wherein the mid hull section further comprises a plurality of mid hull section support columns extending from the mid hull section sloping bottom to the deck and the columns form holes in the mid hull section sloping bottom;

a stern handle integral with the hull and the deck and formed in the vessel stern;

a bow handle integral with the hull and the deck and formed in the vessel bow;

b. at least one air release valve for emergency release of air from the interior of the hull disposed in the deck; and c. a filler disposed between the one piece hull and the deck forming a one piece vessel.

2. The vessel of claim 1, wherein the deck further comprises skid reducing dimples.

3. The vessel of claim 1, wherein the deck further comprises shallow channels enabling water to run off of the deck.

4. The vessel of claim 1, wherein the vessel has an overall length from 8 to 18 feet, an overall width from 33 to 45 inches, and overall hull thickness from 6 to 8 inches resulting in a draft of less than 6 inches.

5. The vessel of claim 1, wherein the filler is a liquid expanding two part urethane foam.

6. The vessel of claim 1, wherein the deck further comprises a plurality of opposing grooves for receiving and supporting a removable seat.

7. The vessel of claim 1, wherein the vessel is individually propelled.

8. The vessel of claim 1, wherein at least 4 support columns and up to 10 support columns are in each hull section and from 3 to 10 support columns are in the mid hull section.

9. The vessel of claim 1, wherein the one piece vessel has a draft from 3 to 6 inches when fully loaded.

10. The vessel of claim 1, further comprising motor mounts disposed in the deck, and wherein the motor mounts are adapted to support a trolling motor placed through a stern hole.

* * * * *